US006942099B1

(12) United States Patent
Wang

(10) Patent No.: US 6,942,099 B1
(45) Date of Patent: Sep. 13, 2005

(54) CUSHION PACKAGE STRUCTURE

(75) Inventor: Mei-Fang Wang, Hisnchu (TW)

(73) Assignee: Accton Technology Corporation, Hsinchu (TW)

( * ) Notice: Subject to any disclaimer, the term of this patent is extended or adjusted under 35 U.S.C. 154(b) by 0 days.

(21) Appl. No.: 10/958,361

(22) Filed: Oct. 6, 2004

(30) Foreign Application Priority Data

May 25, 2004 (TW) ..... 93114693 A

(51) Int. Cl.[7] ..... B65D 81/02
(52) U.S. Cl. ..... 206/521; 206/592
(58) Field of Search ..... 206/305, 320, 206/521, 576, 583, 588, 591, 592, 594, 525

(56) References Cited

U.S. PATENT DOCUMENTS 3,921,890 A * 11/1975 Reihm ..... 206/592
5,341,934 A * 8/1994 Hsu ..... 206/591
5,803,267 A * 9/1998 Tu et al. ..... 206/576
5,979,659 A * 11/1999 Kataoka ..... 206/591
6,268,039 B1 * 7/2001 Chou et al. ..... 206/586
6,685,025 B1 * 2/2004 Kari ..... 206/592

* cited by examiner

*Primary Examiner*—Luan K. Bui
(74) *Attorney, Agent, or Firm*—Troxell Law Office, PLLC

(57) ABSTRACT

A cushion package structure formed from a foldable material partially coated with an adhesive mainly comprises: a first plane, a second plane, a first bending side, a second bending side, an opening, an abutting plane, an adhesive plane, and an extensive body, etc. The cushion package structure may be integrally formed and manufactured as a blank, and the first bending side and the second bending are just straightened up while being used. After the packed object is placed from a side of the package structure, the abutting planes may surely abut against the packed object to fix the position thereof, such that the packed object won't be damaged by shaking. Since the cushion package structure 2 has protecting legs contacting all six surfaces of a virtual box surrounding the cushion package structure, so it is guaranteed that the structure is capable of anti-vibrating and positioning.

19 Claims, 5 Drawing Sheets

CUSHION PACKAGE STRUCTURE

FIELD OF THE INVENTION

The invention is related to a cushion package structure formed from a foldable material partially coated with an adhesive, and more particularly, to a cushion package structure which is integrally formed from a foldable material partially coated with an adhesive and has anti-vibration structure, that the invention is suitable for packing fragile objects, such as computer peripherals, etc.

BACKGROUND OF THE INVENTION

Following the rapid progress of computer technology, there are more varieties of computer peripherals, such as access point and router, etc. When shipping those peripherals, cushion package structure of different types are commonly used to protect those fragile objects from being damage by impact of dropping or collision.

Please refer to FIG. 1, which shows a conventional packaging structure for computer peripheral. The package structure comprises three parts, that is, a power line storage 100 for storing the power line of a packed object 102, a main storage 101 for accommodating the packed object 102, and a box 103 for receiving both the power line storage 100 and the main storage 101.

In view of the above description, the conventional package structure for computer peripherals at least has the shortcomings as following:

1. Since there are at least two parts, i.e. the power line storage 100 and the main storage 101, required in the conventional package structure so as to protect the packed object, a lot of material is wasted during the making of those structures which greatly increases their manufacturing cost.
2. The manufacturing process of the conventional package structure of FIG. 1 requires 24 folding steps, that is very tedious and troublesome.
3. While placing the packed object 102 into the main storage 101, the two side of the main storage 101 has to be flip over so that a side of the packed object 102 can be inserted into one side of the main storage 101 first, and thereafter another side of the packed object 102 can be placed into another side of the main storage 101, that the whole process is inconvenient.
4. There is no additional anti-vibration structure in the conventional packaging structure, that it can not provide a satisfactory protection for packed objects.

SUMMARY OF THE INVENTION

The primary objective of the invention is to provide a cushion package structure integrally formed from a foldable material partially coated with an adhesive, such that it is cost efficient by saving materials for making the same.

Another objective of the invention is to provide a cushion package structure formed from a foldable material partially coated with an adhesive, which only needs six folding steps to complete the making of the structure, so a lot of folding time is saved and it is also convenient for the operator.

Yet, another object of the invention is to provide a cushion package structure formed from a foldable material partially coated with an adhesive, which is capable of receiving the packed object from a side of the structure for increasing the convenience of accessing the packed object.

Yet, another object of the invention is to provide a cushion package structure formed from a foldable material partially coated with an adhesive, which has a plurality of cushion pads contacting all six surfaces of a virtual box surrounding the cushion package structure for the purposes of anti-vibration and fixation.

In accordance with one aspect of this invention, there is provided a cushion package structure formed from a foldable material partially coated with an adhesive, the cushion package structure including: a first plane; a second plane having an extensive body, being disposed with respect to the first plane; at least a first bending side, having a first bend line and a second bend line arranged thereon for connecting respectively to the second plane and the first plane therewith so as to separate the first plane from the second plane by an altitude; an opening, being arranged on the first bending side and extending out of the same into the first plane and the second plane respectively by a length; at least an abutting plane, being received by the opening, and having a folding side arranged thereon for connecting to the first bending side therewith so as to enable the abutting plane to be used for seal the opening, and at least an edge disposed at a side thereof close to the first pane and being capable of extruding the first plane while integrating the cushion package structure and at least an edge disposed at a side thereof close to the second plane and being capable of extruding the second plane while integrating the cushion package structure; at least a second bending side having a first flange extruding the second plane and a third bend line arranged thereon for connecting to the second plane therewith; and an adhesive plane enabling the attachment to the first plane, having a fourth bend line arranged thereon for connecting to the second bending side therewith, wherein the fourth bend line further has a second flange capable of extruding the first plane while integrating the cushion package structure.

Following drawings are cooperated to describe the detailed structure and its connective relationship according to the invention for facilitating your esteemed members of reviewing committee in understanding the characteristics and the objectives of the invention.

BRIEF DESCRIPTION OF THE DRAWINGS

FIG. 2B is an exemplary illustration of a cushion package structure according to a preferable embodiment of the present invention showing the packed objects are being placed in.

DETAILED DESCRIPTION OF THE INVENTION

For your esteemed members of reviewing committee to further understand and recognize the fulfilled functions and structural characteristics of the invention, several preferable embodiments cooperating with detailed description are presented as the follows.

Figure 1:
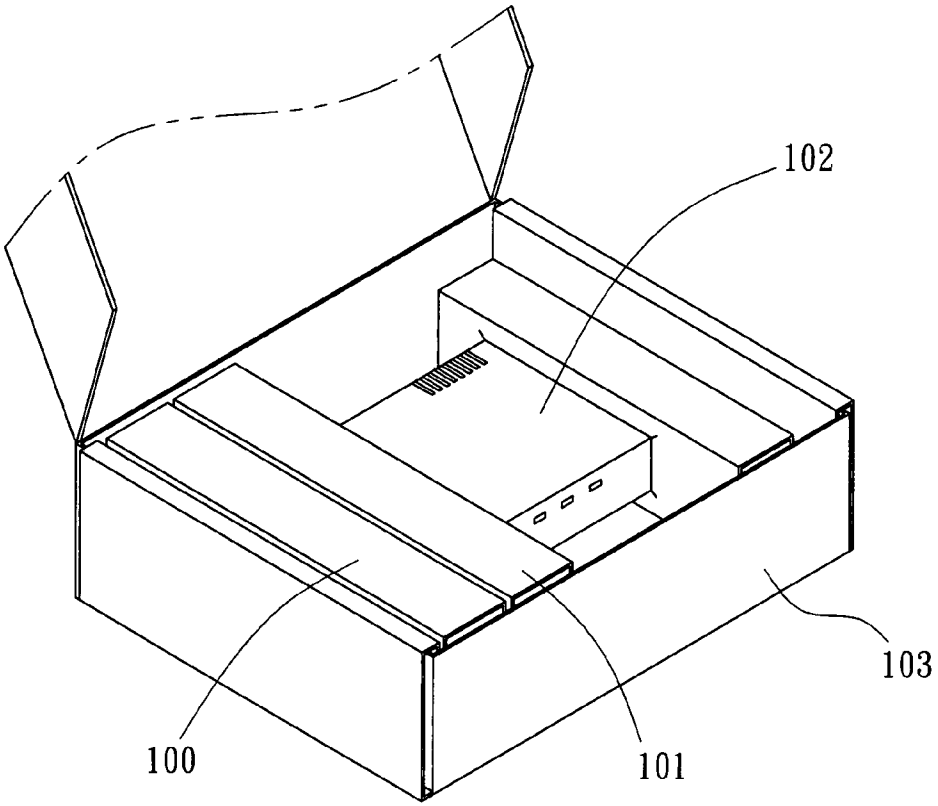
FIG. 1 (PRIOR ART)
FIG. 1 is an exemplary illustration of a conventional package structure.
Figure 2A:
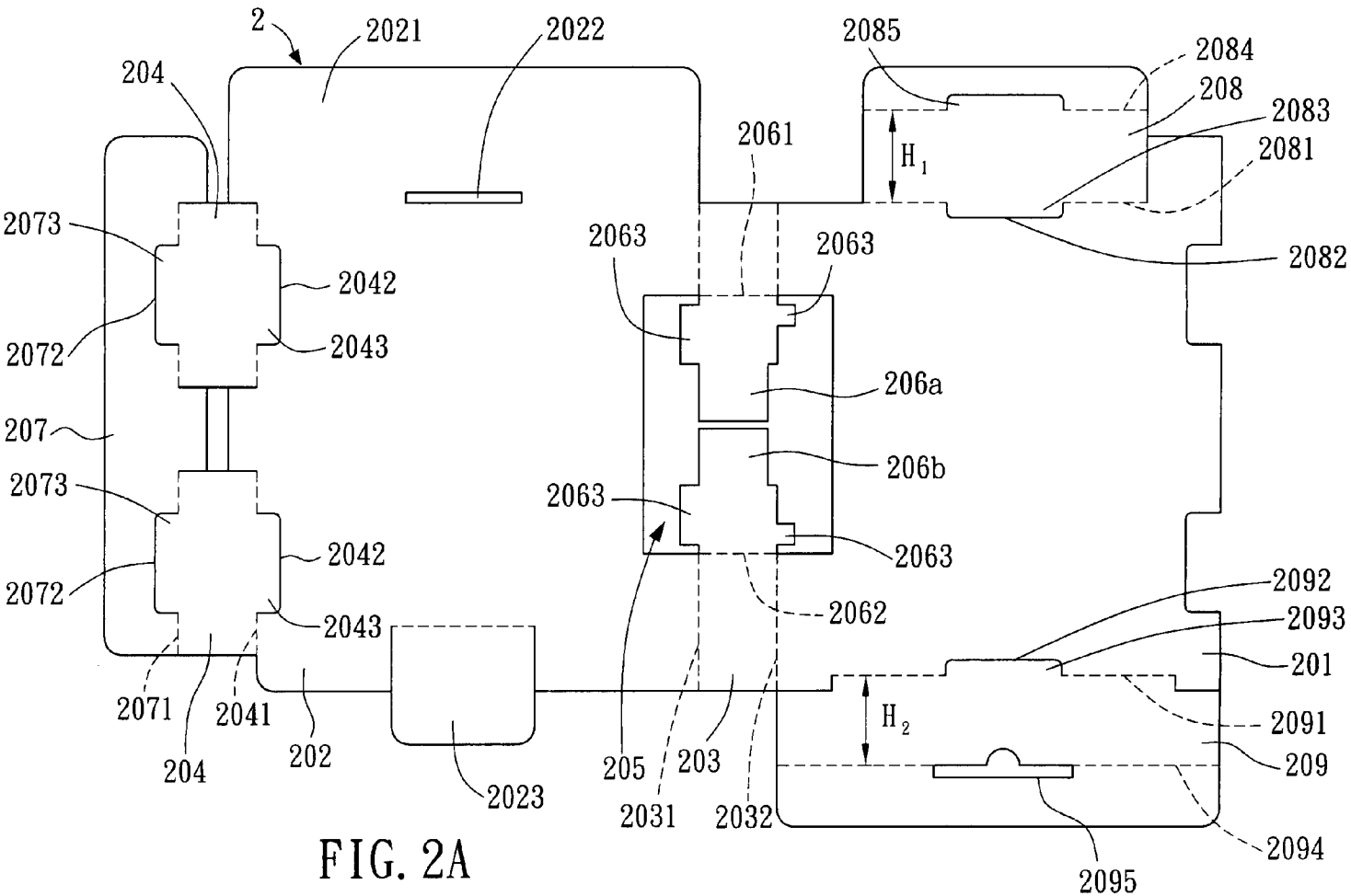
FIG. 2A is a developing illustration of a cushion package structure according to a preferable embodiment of the present invention.

Please refer to FIG. 2A, which is a developing illustration of a cushion package structure according to a preferable embodiment of the present invention. The cushion package structure mainly includes: a first plane 201, a second plane 202, a first bending side 203, a second bending side 204, an opening 205, two abutting planes 206*a*, 206*b*, and an adhesive plane 207, wherein the second plane 202 has an extensive body 2021 for placing the power line of a packed object (not shown). The first bending side 203 is adjacent to the second plane 202 by a first bend line 2031 and is also adjacent to the first plane 201 by a second bend line 2032. The opening 205 is arranged at the first bending side 203 and is extended out of the first plane 201 and the second plane 202 with a length respectively. The two abutting planes 206*a*, 206*b* are adjacent to the first bending side 203 with the folding sides 2061, 2062 respectively and are extended into the opening 205. The two sides of the abutting planes 206*a*, 206*b* further have edges 2063 extending outwardly. The second bending side 204 is adjacent to the second plane 202 by a third bend line 2041, which further has a first flange 2043 cooperating with a first groove 2042 arranged at the second plane 202. The adhesive plane 207 is adjacent to the second bending side 204 by a fourth bend line 2071, which further has a second flange 2073 cooperating with a second groove 2072 arranged at the adhesive plane 207. Adhesive is coated on the adhesive plane 207 and a surface of the first plane 201 for a subsequently adhering procedure.

One end of the first plane 201 is further extended out of a blocking plane 208, which is adjacent to the first plane 201 by a fifth bend line 2081, which further has a third flange 2083 cooperating to a third groove 2082 arranged at the first plane 201. The blocking plane 208 further has a sixth bend line 2084, which is an altitude $H_1$ apart from the fifth bend line 2081. The sixth bend line 2084 further has a fourth flange 2085. Another end of the first plane 201 is extended out of a sealing plane 209, which is adjacent to the first plane 201 by a seventh bend line 2091, and the seventh bend line 2091 further has a fifth flange 2093 cooperating to a fourth groove 2092 arranged at the first plane 201. The sealing plane 209 further has an eighth bend line 2094 that is an altitude $H_2$ apart from the seventh bend line 2091.

The eighth bend line 2094 further has a trough 2095 for receiving a sixth flange 2023 of the second plane 202. The extensive body 2021 has a hole 2022 arranged therein for receiving the fourth flange 2085. Such kind of design for cushion package structure 2 can be integrally formed by a cutting process.

Figure 2B:
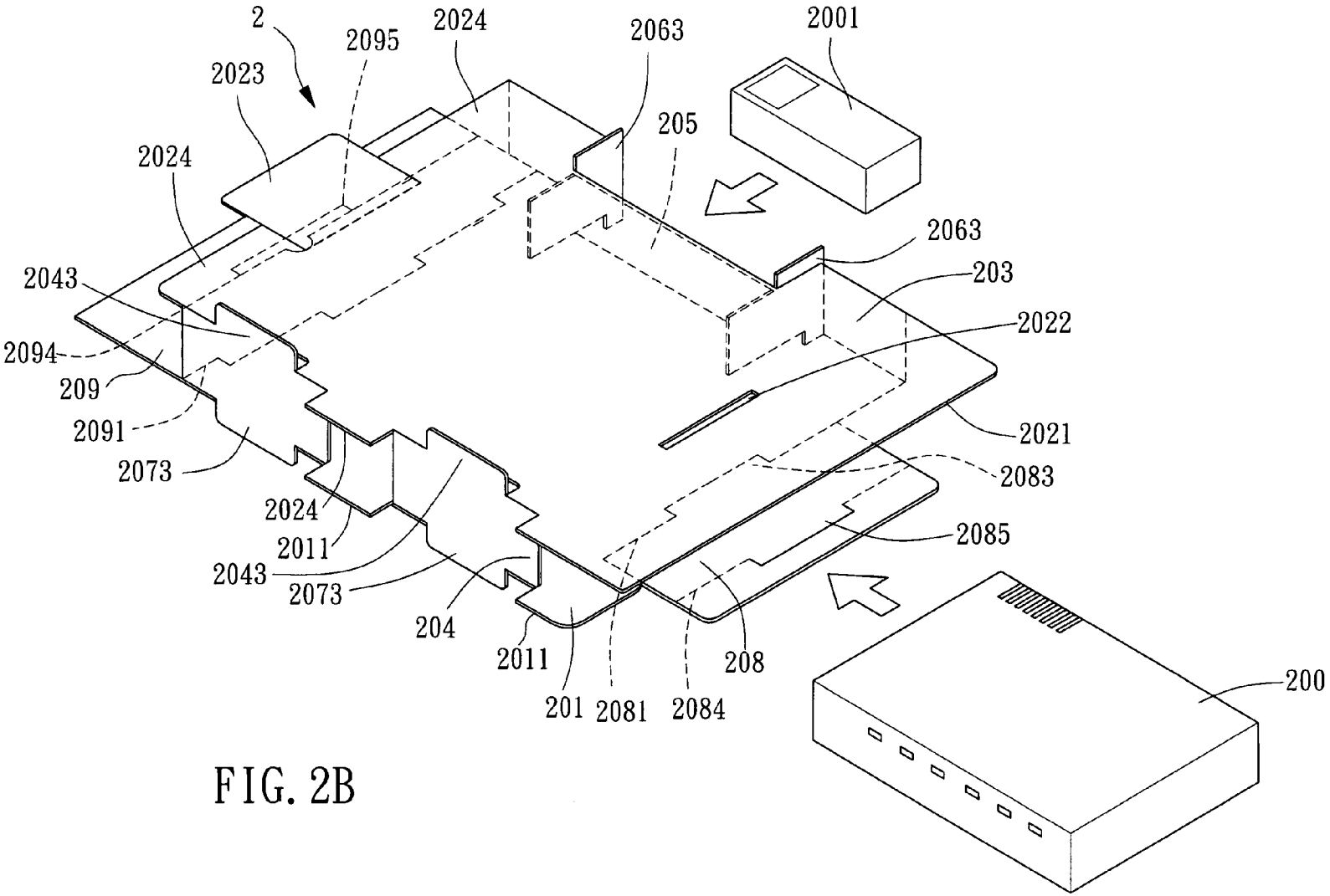
Figure 2C:
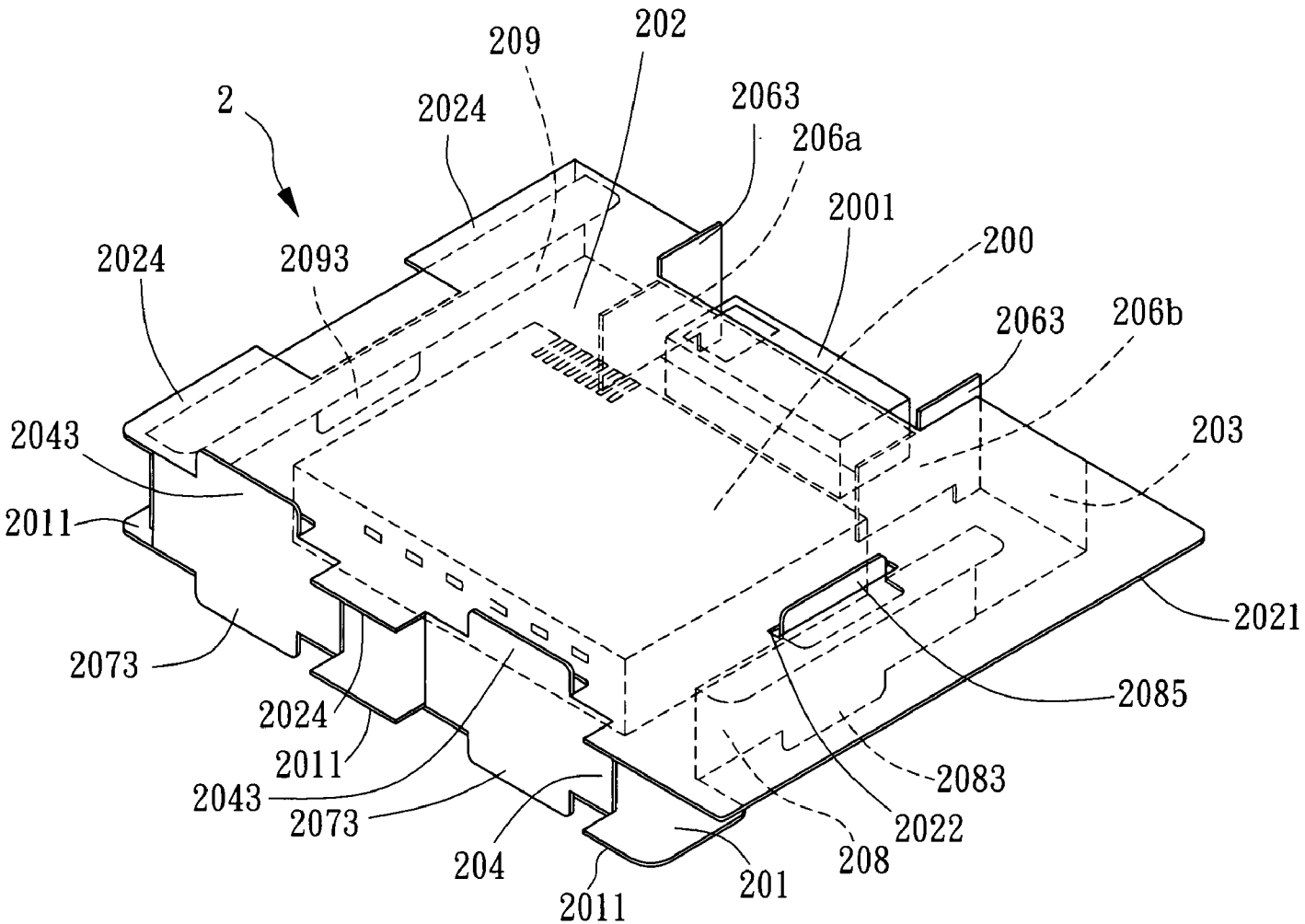
FIG. 2C is an exemplary illustration showing an assembled cushion package structure according to a preferable embodiment of the present invention.

Please refer to FIG. 2B and FIG. 2C, which is an exemplary illustration of a cushion package structure according to a preferable embodiment of the present invention showing the packed objects are being placed in, and an exemplary illustration showing an assembled cushion package structure according to a preferable embodiment of the present invention. Since the adhesive plane 207 and one side of the first plane 201 have already been adhered together to be stored as a blank, so it may be integrally manufactured, and it only needs to straight up the first bending side 203 and the second bending side 204 during the blank being used. The packed object 200 is being placed in the package structure from the side opening, while the transformer 2001 is being placed in from the opening 205. The blocking plane 208 is folded along the fifth bend line 2081 and the sixth bend line 2084, while the sealing plane 209 is folded along the seventh bend line 2091 and the eighth bend line 2094, and then the sixth flange 2023 is being inserted into the trough 2095. At this time, as shown in FIG. 2C, the flange 2011 of the first plane 201 is exposed and the flange 2024 of the second plane 202 is exposed as well, while the extensive body 2021 extruding above the horizontal axis. The fourth flange 2085 of the blocking plane 208 first passes through the hole 2022 and is then projected out of the extensive body 2021. The first flange 2043, the second flange 2073, the third flange 2083, the edge 2063, and the fifth flange 2093 are also straightened upwardly along a vertical axis. After the packed object 200 is being placed in the package structure, the abutting planes 206*a*, 206*b* may be securely abutted against the packed object 200 for fixing its position, such that the packed object 200 won't be damaged from shaking. Since the cushion package structure 2 has protecting legs contacting all six surfaces of a virtual box surrounding the cushion package structure, so it is guaranteed that the structure is capable of anti-vibrating and positioning.

Figure 3:
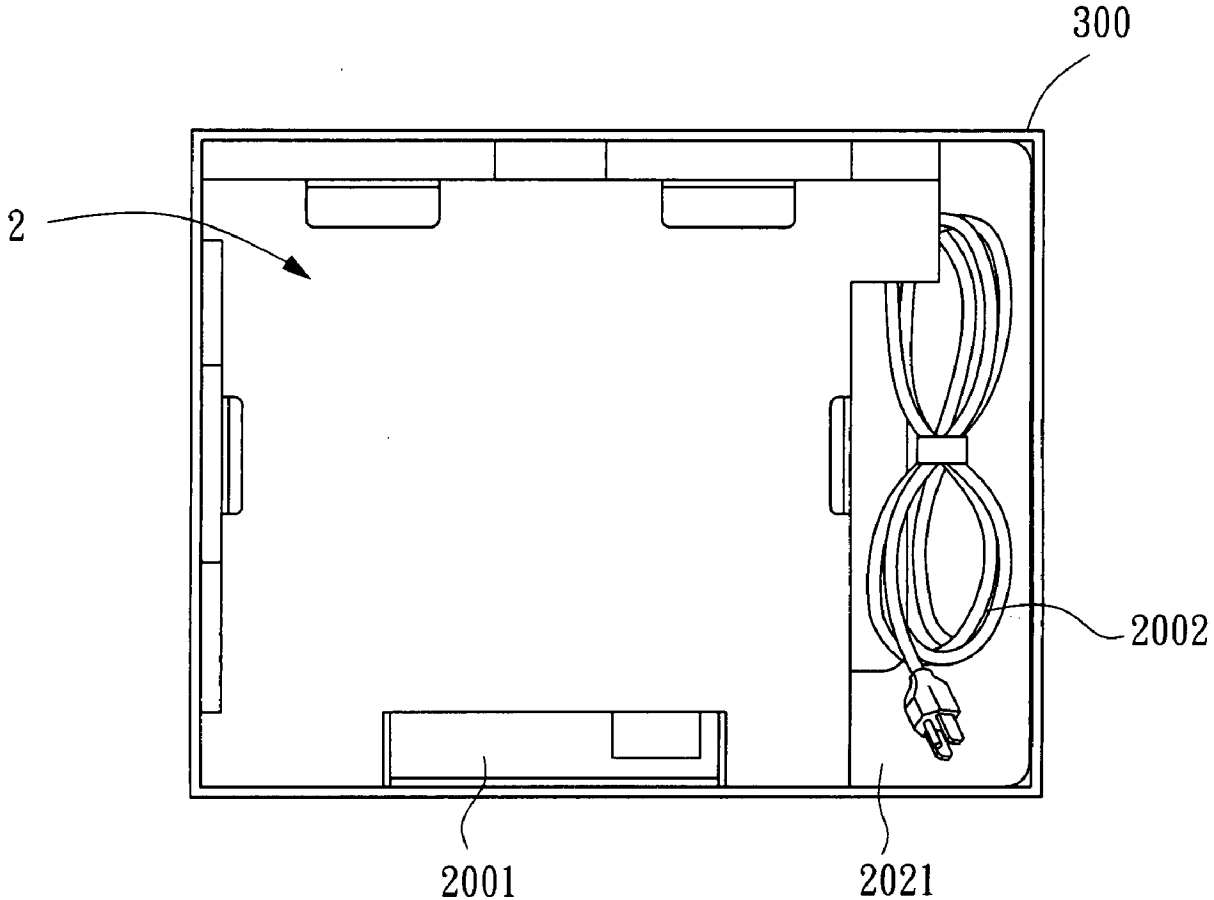
FIG. 3 is an exemplary illustration showing a cushion package structure of the present invention in a cooperated box.

As shown in FIG. 3, which is an exemplary illustration showing a cushion package structure 2 of the present invention in a cooperated box 300, wherein a packed object 200 and a transformer 2001 is being packed using the cushion package structure 2. As seen, the power line 2002 is placed in the extensive body 2021, and the packed object 200 and the transformer 2001 are packed in the interior of the package structure 2, and the package structure 2 packed with the packed object 200, the transformer 200 and the power line 2002 is being placed in the box 300. It is quick and simple.

In summarizing aforementioned description, the present invention provides a cushion package structure integrally formed from a foldable material partially coated with an adhesive, that it is cost efficient by saving materials for making the same, and has a plurality of cushion legs contacting all six surfaces of a virtual box surrounding the cushion package structure for the purposes of anti-vibration and fixation. However, the aforementioned description is only the preferable embodiments according to the invention and, of course, can not be applied as a limitation to the field of the invention, and any equivalent variation and modification that may be easily conceived by those who are skilled in such arts after understanding the spirit of the invention, such as: the variation of the positions, number, and forms of the flanges, and made according to the claims claimed thereinafter still possess the merits of the invention and are still within the spirits and the ranges of the invention, so they should be deemed as a further executing situation of the invention.

In summary, the structural characteristics and each embodiment have already been disclosed in detail to sufficiently show that this invention has deeply executable progressiveness on both objective and function, great applying value in industry, and never been seen in current market, so this invention is completely fulfilled the merits of a patent application. Please your members of reviewing committee review the present application as carefully as possible and favorably grant it as a formal patent as soon as possible.

What is claimed is:

1. A cushion package structure, formed from a foldable material partially coated with an adhesive, comprising:

a first plane;

a second plane, having an extensive body;

at least a first bending side, having a first bend line arranged thereon for connecting to the second plane therewith and a second bend line arranged thereon for connecting to the first plane therewith;

an opening, being arranged on the first bending side, and extending out of the same into the first plane and the second plane respectively by a length;

at least an abutting plane received by the opening, having a folding side arranged thereon for connecting to the first bending side therewith, at least an edge disposed at a side thereof close to the first plane and being capable of extruding the first plane while integrating the cushion package structure, and at least an edge disposed at a side thereof close to the second plane and being capable of extruding the second plane while integrating the cushion package structure;

at least a second bending side, having a third bend line arranged thereon for connecting to the second plane therewith, wherein the third bend line further comprises a first flange arranged corresponding to a first groove of the second plane; and an adhesive plane, having a fourth bend line arranged thereon for connecting to the second bending side therewith, and a second groove arranged thereon, wherein the fourth bend line further comprises a second flange disposed corresponding to the second groove.

2. The cushion package structure according to claim 1, wherein the cushion package structure is integral formed.

3. The cushion package structure according to claim 1, wherein the adhesive plane is coated with the adhesive.

4. The cushion package structure according to claim 1, wherein one surface of the first plane is coated with the adhesive.

5. The cushion package structure according to claim 1, wherein the first plane further comprises an blocking plane and a third groove arranged thereon, and the blocking plane having a fifth bend line arranged thereon for connecting to the first plane therewith and a third flange arranged corresponding to a third groove.

6. The cushion package structure according to claim 5, wherein the blocking plane further has a sixth bend line being arranged apart from the fifth bend line by a height.

7. The cushion package structure according to claim 6, wherein the sixth bend line further has a fourth flange.

8. The cushion package structure according to claim 7, wherein the first plane further has a sealing plane extending outwardly and a fourth groove arranged thereon, and the sealing plane having a seventh bend line arranged thereon for connecting to the first plane therewith, and a fifth flange arranged corresponding to the fourth groove.

9. The cushion package structure according to claim 8, wherein the sealing plane further has a eighth bend line being apart from the seventh bend line by an altitude.

10. The cushion package structure according to claim 9, wherein the eighth bend line further has a trough.

11. A cushion package structure, formed from a foldable material partially coated with an adhesive, comprising:

a first plane;

a second plane having an extensive body, being arranged with respect to the first plane;

at least a first bending side, having a first bend line arranged thereon for connecting to the second plane therewith and a second bend line arranged thereon for connecting to the first plane therewith, enabling the separation of the first plane and the second plane by an altitude;

an opening, being arranged on the first bending side, and extending out of the same into the first plane and the second plane respectively by a length;

at least an abutting plane, received by the opening for sealing the same, having a folding side arranged thereon for connecting to the first bending side therewith, at least an edge disposed at a side thereof close to the first plane and being capable of extruding the first plane while integrating the cushion package structure, and at least an edge disposed at a side thereof close to the second plane and being capable of extruding the second plane while integrating the cushion package structure;

at least a second bending side, having a third bend line arranged thereon for connecting to the second plane therewith, wherein the third bend line further comprises a first flange extruding out of the second plane; and an adhesive plane, enabling the attachment to the first plane, having a fourth bend line arranged thereon for connecting to the second bending side therewith, wherein the fourth bend line further has a second flange extruding out of the first plane.

12. The cushion package structure according to claim 11, wherein the cushion package structure is integral formed.

13. The cushion package structure according to claim 11, wherein the adhesive plane is coated with the adhesive.

14. The cushion package structure according to claim 11, wherein one surface of the first plane is coated with the adhesive.

15. The cushion package structure according to claim 11, wherein the cushion package structure further comprises: a blocking plane, having a fifth bend line arranged thereon for connecting to the first plane therewith and a third flange extruding out of the first plane.

16. The cushion package structure according to claim 15, wherein the blocking plane further comprises a sixth bend line arranged thereon for connecting to the second plane therewith, and the sixth bend line has a fourth flange inserted into a hole arranged at the extensive body for extending out of the second plane.

17. The cushion package structure according to claim 15, wherein the extensive body is extended out of the blocking plane.

18. The cushion package structure according to claim 16, wherein the cushion package structure further comprises: a sealing plane, having a seventh bend line arranged thereon for connecting to the first plane therewith and a fifth flange extruding out of the first plane.

19. The cushion package structure according to claim 18, wherein the sealing plane further comprises an eighth bend line arranged thereon for connecting to the second plane therewith, and the eighth bend line further has a trough for receiving a sixth flange of the second plane.

* * * * *